US010236630B2

(12) United States Patent
Naito et al.

(10) Patent No.: US 10,236,630 B2
(45) Date of Patent: Mar. 19, 2019

(54) ELECTRICAL CONNECTOR WITH FIRST AND SECOND LEVERS

(71) Applicant: Molex, LLC, Lisle, IL (US)

(72) Inventors: Yuji Naito, Yamato (JP); Takeshi Kon, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/948,305

(22) Filed: Apr. 9, 2018

(65) Prior Publication Data

US 2018/0301847 A1 Oct. 18, 2018

(30) Foreign Application Priority Data

Apr. 12, 2017 (JP) ..... 2017-078940

(51) Int. Cl.
*H01R 13/629* (2006.01)
*H01R 13/62* (2006.01)

(52) U.S. Cl.
CPC ..... *H01R 13/62966* (2013.01); *H01R 13/62* (2013.01); *H01R 13/62955* (2013.01)

(58) Field of Classification Search
CPC ..... H01R 13/62; H01R 13/62955; H01R 13/62972
USPC ..... 439/372
See application file for complete search history.

(56) References Cited

U.S. PATENT DOCUMENTS 3,488,622 A * 1/1970 Gley ..... H01R 13/629 439/157
5,564,935 A * 10/1996 Yagi ..... H01R 13/62966 439/157
5,873,745 A * 2/1999 Duclos ..... H01R 13/62944 439/157
6,019,620 A * 2/2000 Kodama ..... H01R 13/62966 439/157
7,066,763 B1 * 6/2006 Corwin ..... H01R 13/62966 439/157
7,094,081 B1 * 8/2006 Senk ..... H01R 9/2425 439/157
7,241,154 B1 * 7/2007 Mauney ..... H01R 13/62938 439/157
7,717,723 B2 * 5/2010 Nehm ..... H01R 13/62966 439/157
7,862,353 B1 * 1/2011 Azad ..... H01R 13/62938 439/157
8,727,803 B2 5/2014 Kurachi
9,692,153 B1 * 6/2017 Rodriguez ..... H01R 13/62938

FOREIGN PATENT DOCUMENTS

JP 3864772 B2 1/2007
JP 2009-289648 A 12/2009

* cited by examiner

*Primary Examiner* — Tulsidas C Patel
*Assistant Examiner* — Travis Chambers
(74) *Attorney, Agent, or Firm* — Molex, LLC

(57) ABSTRACT

The present disclosure includes: housing for housing terminals; first lever which is mounted in housing to allow change of position between an initial position and a lock position, and which allows locking a mating lock member of a mating connector in the lock position; and second lever which is mounted in housing to allow change of position between an initial position and an auxiliary lock position, and which allows locking first lever at the lock position in the auxiliary lock position.

13 Claims, 12 Drawing Sheets

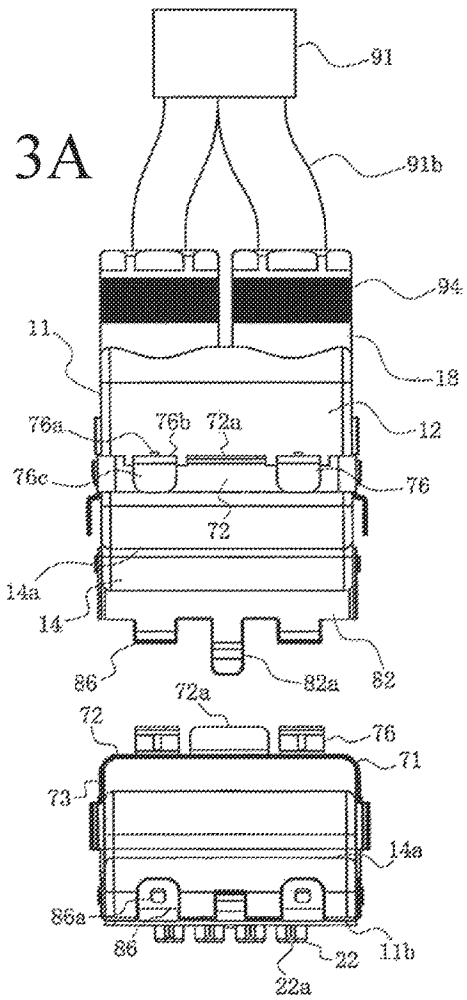
FIG. 3A
FIG. 3B
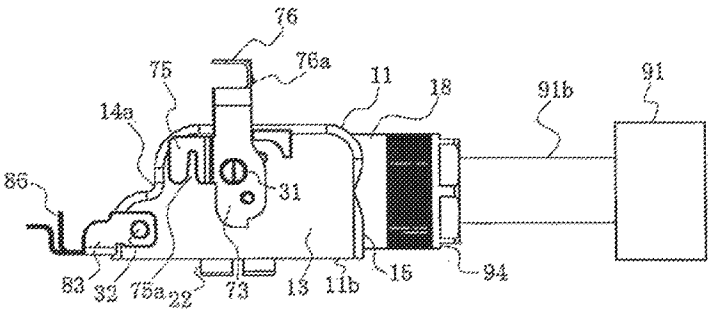
FIG. 3C

ELECTRICAL CONNECTOR WITH FIRST AND SECOND LEVERS

RELATED APPLICATIONS

This application claims priority to Japanese Application No. 2017-078940, filed Apr. 12, 2017, which is incorporated herein by reference in its entirety.

TECHNICAL FIELD

The present disclosure relates to a connector.

BACKGROUND ART

Conventionally, connectors mating with a mating connector have an engaging lever including an engaging groove; wherein, when the engaging lever is rotated in the state in which the engaging groove engages with an engaging projection provided in the housing of the mating connector, the mating force is increased, causing the mutual connectors to be assuredly mated (for example, see Patent Document 1).

FIG. 9 is a side view illustrating a conventional connector and mating connector.

In the figure, 811 is a housing of a connector made of an insulating material, which mates with mating housing 911 of the mating connector, which is also made of an insulating material. Multiple terminals (not illustrated) are housed in housing 811. Moreover, multiple mating terminals (not illustrated) are housed in mating housing 911. Note that electric wires (not illustrated) are connected to each of the terminals and mating terminals.

Additionally, engaging projection 918 is formed on the side face of mating housing 911. Moreover, engaging lever 881, in which engaging groove 883 that can engage with engaging projection 918 is formed, is mounted in housing 811. This engaging lever 881 is mounted so as to be pivotable about pivot 875 protruding from the side face of housing 811.

While engaging lever 881 is kept in the initial position as illustrated in the figure, when housing 811 is relatively moved to the right in the figure so as to mate with mating housing 911, engaging projection 918 enters engaging groove 883 so as to be housed therein. Subsequently, when engaging lever 881 is pivoted in the clockwise direction in the figure, engaging projection 918 engages with engaging groove 883 so as to be undetachable therefrom. Additionally, if engaging lever 881 is pivoted until the upper end part of engaging lever 881 abuts upper wall 814 protruding from the upper surface of housing 811, engaging projection 815*a* of lock arm 815 formed on the upper surface of housing 811 engages with an engaging part formed inside the upper end part of engaging lever 881. As a result, engaging lever 881 is positioned.

Patent Document 1: JP 2009-289648 A

SUMMARY

Unfortunately, in conventional connectors, the inside of the upper end part of engaging lever 881 engages with engaging projection 815*a* of lock arm 815, making it difficult to visually confirm from the outside whether engaging lever 881 has been positioned. Therefore, upon carrying out the operation to mate housing 811 and mating housing 911, engaging lever 881 may be left standing without being assuredly positioned. In this case, engaging lever 881 may be returned to the initial position, consequently releasing the mating between housing 811 and mating housing 911.

Moreover, because engaging lever 881 only engages with engaging projection 815*a* of lock arm 815, the engagement with engaging projection 815*a* may be released upon receiving external force such as an impact or vibrations, potentially causing engaging lever 881 to return to the initial position.

Herein, in order to solve the conventional problems, an object is to provide a connector such that the locking is not released even upon receiving external force such as an impact or vibrations, the mating state with a mating connector can be assuredly maintained, the structure is simple, the cost is low, and reliability is high.

Accordingly, a connector includes: a housing for housing terminals; a first lever which is mounted in the housing to allow change of position between an initial position and a lock position, and which allows locking of a mating lock member of a mating connector in the lock position; and a second lever which is mounted in the housing to allow change of position between an initial position and an auxiliary lock position, and which allows locking the first lever at the lock position in the auxiliary lock position.

In another connector, further, the first lever and the second lever are locked by a latch member.

In still another connector, further, the latch member is present at two locations in a width direction.

In still another connector, further, the second lever includes an operation piece, with the operation piece present between the latch members at two locations in the width direction.

In still another connector, further, the first lever and the second lever are swingably mounted in the housing, such that a direction in which the first lever swings from the initial position to the lock position is opposite to a direction in which the second lever swings from the initial position to the auxiliary lock position.

In still another connector, further, the mating connector includes mating terminals contactable with the terminals, and a mating housing including a peripheral wall surrounding the periphery of the mating terminals, the housing includes a recess mating with the peripheral wall, and the mating between the peripheral wall and the recess prevents displacement in a direction orthogonal to the mating release direction of the housing from the mating housing.

In still another connector, further, displacement in the mating release direction of the housing from the mating housing is prevented by the first lever locking the mating lock member.

A connector assembly includes: the connector; and the mating connector including the mating terminals contactable with the terminals, the mating lock member locked by the first lever, and the mating housing having the mating terminals and the mating lock member.

In accordance with the connector of the present disclosure, the locking is not released even upon receiving external force such as an impact or vibrations, while allowing the mating state with the mating connector to be assuredly maintained. Moreover, the structure can be simplified, enabling cost reduction, as well as improved reliability.

BRIEF DESCRIPTION OF THE DRAWINGS

FIGS. 3A-3C are three surface views of the connector according to the present embodiment, wherein FIG. 3A is a top view, FIG. 3B is a front view, and FIG. 3C is a side view.

FIGS. 5A-5B are perspective views of a mating connector according to the present embodiment, wherein FIG. 5A is a perspective view viewed from above, while FIG. 5B is a perspective view viewed from below.

DETAILED DESCRIPTION OF THE PREFERRED EMBODIMENTS

Embodiments will be described in detail below with reference to the drawings.

Figure 1:
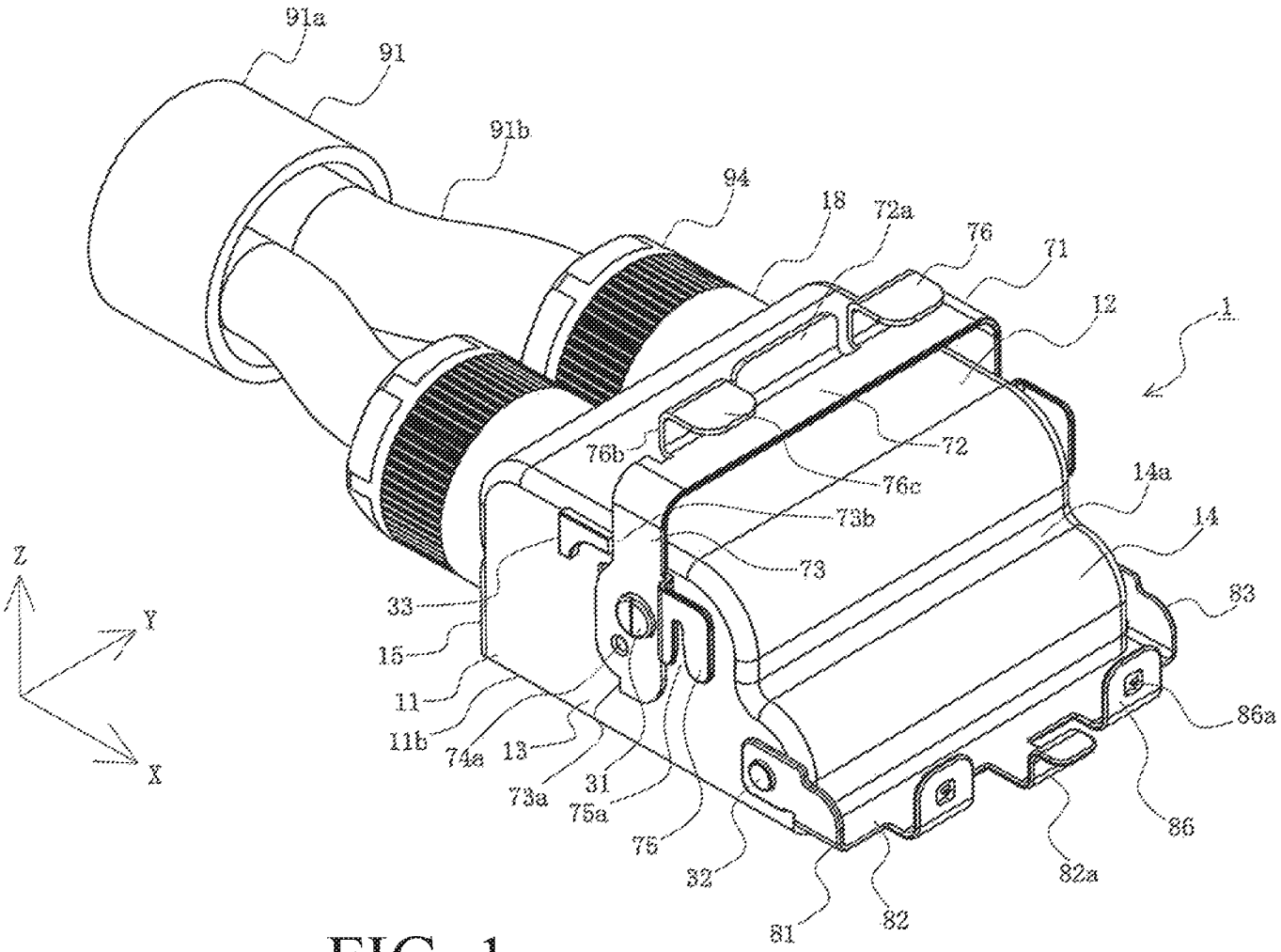
FIG. 1 is a first perspective view of a connector according to the present embodiment.
Figure 2:
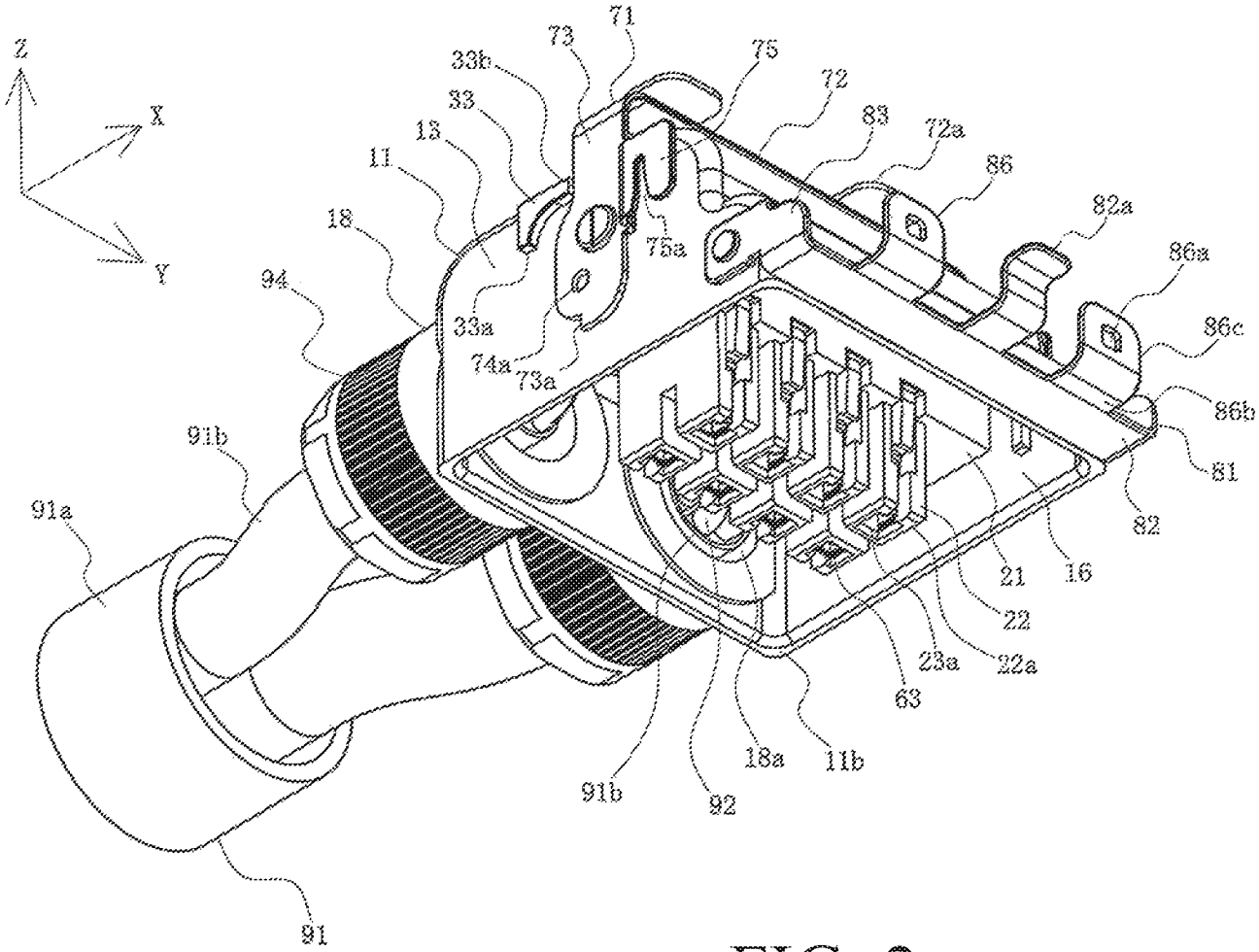
FIG. 2 is a second perspective view of the connector according to the present embodiment.
Figure 4A:
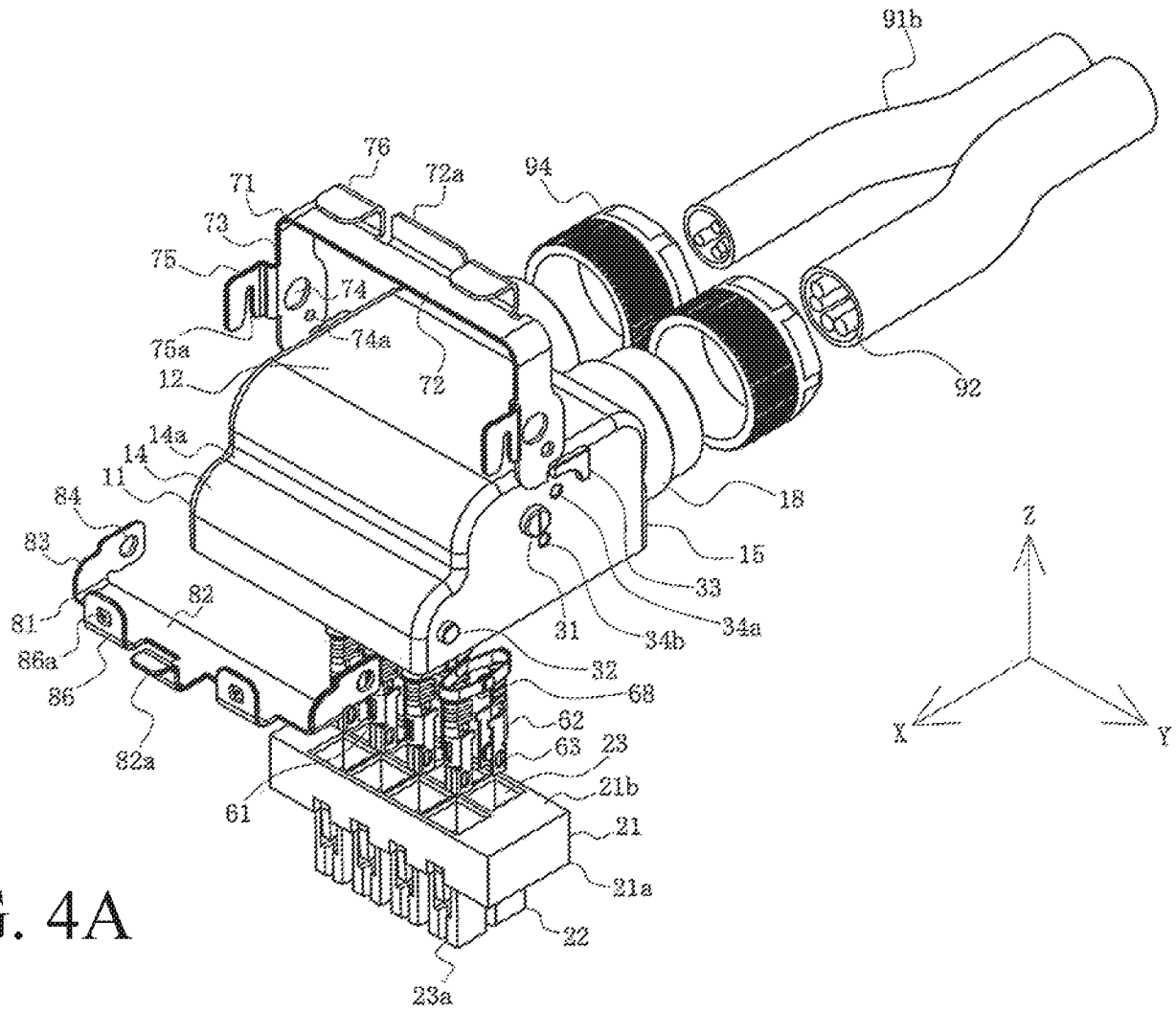
FIG. 4A is an exploded view of the connector according to the present embodiment.
Figure 4B:
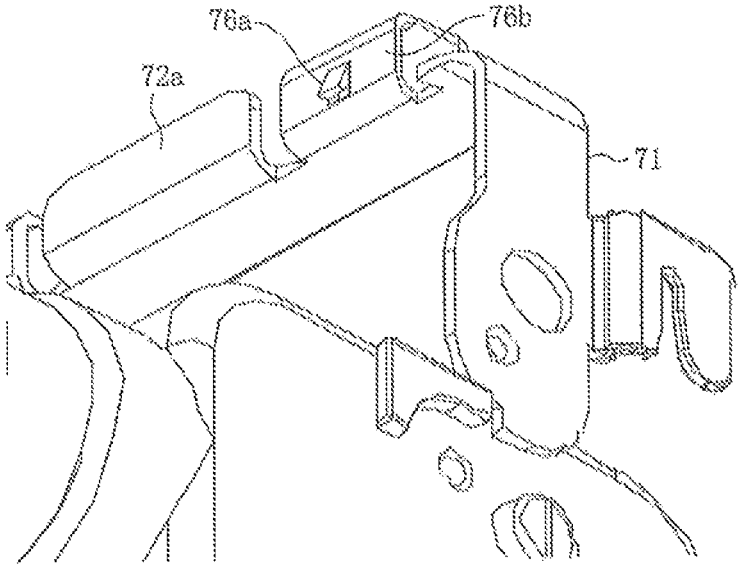
FIG. 4B is an enlarged view of a latch projection according to the present embodiment.

FIG. 1 is a first perspective view of a connector according to the present embodiment, FIG. 2 is a second perspective view of the connector according to the present embodiment, FIGS. 3A-3C are three surface views of the connector according to the present embodiment, FIG. 4A is an exploded view of the connector according to the present embodiment, and FIG. 4B is an enlarged view of a latch projection according to the present embodiment. Note that FIG. 3A is a top view, FIG. 3B is a front view, and FIG. 3C is a side view.

In the figures, 1 is a connector according to the present embodiment connected to the terminal of cable 91 including multiple electric wires 92, and mates with mating connector 101 described below. Connector 1 and mating connector 101, for example, are used in a variety of electronic equipment, along with a variety of equipment such as household equipment, medical equipment, industrial equipment, and transport equipment, but may be used in any application. Here, for convenience of description, these members are those as are used in transport equipment such as automobiles, as well as industrial equipment such as robots.

Note that in the present embodiment, expressions indicating directions such as up, down, left, right, front, and back that are used to describe the configuration and operation of each part included in connector 1, mating connector 101, and other members are relative and not absolute, and are suitable when each part included in connector 1, mating connector 101, and other members is in the position illustrated by the drawings; however, when the position of each part included in connector 1, mating connector 101, and other members is changed, then these expressions should be interpreted to change corresponding to the changes in positions.

Connector 1 includes housing 11 integrally formed of an insulating material such as synthetic resin, along with multiple metal terminals 61 housed in housing 11. Housing 11 is a box shaped hollow member having a substantially rectangular body that extends in the width direction, that is, the transverse direction (Y axis direction) of connector 1, the longitudinal direction, that is, the anteroposterior direction (X axis direction) of connector 1, and the thickness direction, that is, the lengthwise direction (Z axis direction) of connector 1. Additionally, housing 11 includes: top plate 12 extending in the X-Y axis direction; a pair of side walls 13 which are connected on both ends in the transverse direction of this top plate 12, and extend in the X-Z axis direction; rear plate 15 which is connected to the back (in the X axis negative direction) end of top plate 12, and extends in the Y-Z axis direction; and front plate 14 which is connected to the front (in the X axis positive direction) end of top plate 12. This front plate 14, as illustrated in FIG. 3C, in a side view, is a member having a shape substantially like two-step stairs and includes stepped recess 14*a* in the middle. Moreover, hollow recess 16 is formed inside housing 11. This recess 16, as illustrated in FIG. 2, opens to lower surface 11*b* of housing 11.

Additionally, terminal holding member 21 integrally formed of an insulating material such as synthetic resin is housed and fixed in recess 16. This terminal holding member 21 includes body part 21*a* having a substantially rectangular body shape, along with multiple (eight in the example illustrated in the figure) pillar shaped terminal holding parts 22 protruding downward (in the Z axis negative direction) from the lower surface of this body part 21*a*. Moreover, multiple (eight in the example illustrated in the figure) terminal housing recesses 23 are formed in terminal holding member 21. Each terminal housing recess 23 passes through the inside of each terminal holding part 22 and body part 21*a*, extends in the vertical direction (Z axis direction), and opens to lower surface 22*a* of each terminal holding part 22 and upper surface 21*b* of body part 21*a*. Additionally, each terminal 61 is housed in each terminal housing recess 23. Note that the portion which opens to lower surface 22*a* of terminal holding part 22 in terminal housing recess 23 functions as mating terminal receiving opening 23*a* into which mating terminal 161 can enter as described below.

Each terminal 61 includes: body part 62; contact part 63 connected to the tip, that is, the lower end of this body par 62; and electric wire connecting part 68 connected to the back end, that is, the upper end of body part 62. Additionally, each terminal 61, as illustrated in FIG. 4A, is housed and held in corresponding terminal housing recess 23 at the position in which contact part 63 is directed downward, while electric wire connecting part 68 is directed upward (in the Z axis positive direction). Note that conductive core wires of corresponding electric wires 92 are connected to electric wire connecting part 68. Moreover, contact part 63 contacts mating terminal 161 which enters terminal housing recess 23 from mating terminal receiving opening 23*a*.

Although cable 91 is a long narrow member, in the figure, for convenience, the illustration of the whole cable is omitted, with only the vicinity of connector 1 illustrated. In the example illustrated in the figure, cable 91 includes eight electric wires 92, with four electric wires 92 as one set housed in each of two internal insulation tubes 91*b*. Note that two internal insulation tubes 91*b* are housed in cylindrical outermost insulation coat 91*a* included in cable 91. Additionally, the terminal of each internal insulation tube 91*b* is connected to cable connecting part 18 protruding backward (in the X axis negative direction) from rear plate 15 of housing 11, via pressing ring 94. As illustrated in FIG. 2, the terminal of internal insulation tube 91*b* is housed in internal space part 18*a* of cable connecting part 18, while each of electric wires 92 stretching from the terminal of internal insulation tube 91*b* passes through the inside of recess 16 of housing 11 and is connected to electric wire connecting part 68 of corresponding terminals 61 held by terminal holding member 21.

First lever 71 for locking to hold the mating state between connector 1 and mating connector 101, as well as second lever 81 for holding the lock state of this first lever 71, is mounted outside housing 11. First lever 71 and second lever 81 may be made of any material, but are desirably formed by subjecting a metal plate material such as stainless steel to processing such as cutting or bending. As a result, even if first lever 71 and second lever 81 are relatively thin members, sufficient strength can be maintained, allowing for these members to be elastically deformed but not plastically deformed upon the application of strong force thereto.

In the example illustrated in the figure, first lever 71 substantially has a U shape or arch shape overall. Specifically, first lever 71 includes first body part 72 linearly extending in the transverse direction (Y axis direction), along with a pair of first legs 73 which are connected on both ends of this first body part 72 and stretch in the direction orthogonal to the direction in which first body part 72 extends. Additionally, as illustrated in FIG. 4A, bearing opening 74 serving as a circular through opening is formed in each first leg 73 and rotatably fitted to the periphery of first pivot 31 fixed to the outer face of side walls 13 of housing 11. As a result, first lever 71 is mounted in housing 11 so as to potentially swing about first pivot 31. Note that the position in the anteroposterior direction (X axis direction) of first pivot 31 corresponds to the center in the anteroposterior direction on lower surface 11*b* of housing 11. That is, first pivot 31 is disposed in the approximate center in the anteroposterior direction of housing 11.

Moreover, for the case in which the position of first lever 71 relative to housing 11 is the initial position as illustrated in FIGS. 1 and 2, as well as the position in which first legs 73 extend in the Z axis direction, lock member 75, which engages with mating lock member 175 as described below, is connected to the side end at the front (in the X axis positive direction) of each first leg 73. Lock recess 75*a* as a lock part is formed in this lock member 75. For the case in which the position of first lever 71 relative to housing 11 is the position in which first legs 73 extend in the Z axis direction as illustrated in FIGS. 1 and 2, this lock recess 75*a* is a groove recess extending in the vertical direction (Z axis direction) so as to open the lower end thereof.

Further, for example, circular small projection 74*a* serving as a swollen part formed by press processing is formed in the vicinity of bearing opening 74 of each first leg 73. This small projection 74*a* is a portion which swells toward the outer face of side walls 13 of housing 11, and therefore, as illustrated in FIGS. 1 and 2, is recessed when viewed from the outside of first legs 73. In contrast, first small recess 34*a* and second small recess 34*b*, which can engage with small projection 74*a*, are formed on the outer face of side walls 13 of housing 11. Additionally, for the case in which the position of first lever 71 is the initial position, small projection 74*a* engages with second small recess 34*b*, such that the initial position of first lever 71 is maintained. Moreover, as mentioned below, for the case in which the position of first lever 71 is the lock position in which first legs 73 extend in the X axis direction, small projection 74*a* engages with first small recess 34*a*, such that the lock position of first lever 71 is maintained. That is, small projection 74*a*, as well as first small recess 34*a* and second small recess 34*b*, functions as a lever side position maintaining part and housing side position maintaining part for maintaining the position of first lever 71.

Further, positioning projection 33 for positioning first lever 71 is formed on the outer face of side walls 13 of housing 11. In contrast, notch 73*a* is formed at the tip of each first leg 73 as a lever side positioning part for positioning first lever 71 by abutting first positioning part 33*a* of positioning projection 33. Moreover, the side end at the back (in the X axis negative direction) of each first leg 73, with the position of first lever 71 serving as the initial position, becomes linear part 73*b* as the lever side positioning part for positioning first lever 71 by abutting second positioning part 33*b* of positioning projection 33.

Additionally, for the case in which the position of first lever 71 is the initial position, when first lever 71 swings in the direction in which first body part 72 is displaced further backward, linear part 73*b* abuts second positioning part 33*b* of positioning projection 33. As a result, first lever 71 is positioned. Moreover, for the case in which the position of first lever 71 is the lock position, when first lever 71 swings in the direction in which first body part 72 is displaced further downward, notch 73*a* abuts first positioning part 33*a* of positioning projection 33. As a result, first lever 71 is positioned.

Operation piece 72*a* is connected to the central part in the transverse direction (Y axis direction) of first body part 72, while lock state holding member 76 is connected on both ends in the transverse direction of this operation piece 72*a*. Operation piece 72*a* is a member for improving the operability of first lever 71 when operated by the finger of an operator or the like, and stretches upward from the side end at the back of first body part 72 for the case in which the position of first lever 71 is the initial position. Moreover, lock state holding member 76, as illustrated in FIG. 3C, is a plate member winding in a chevron shape in the side view, and has body part 76*b* stretching upward from the side end at the back of first body part 72 for the case in which the position of first lever 71 is the initial position, along with auxiliary plate part 76*c* stretching forward from the upper end (tip) of this body part 76*b*; and further, latch projection 76*a* protruding backward is formed on body part 76*b*. Additionally, for the case in which the position of first lever 71 is the initial position, first body part 72 is separated from top plate 12 of housing 11 so as to be disposed above this top plate 12. Moreover, for the case in which the position of first lever 71 is the lock position, the side end opposite the side end connected to operation piece 72*a* in first body part 72 approaches or abuts stepped recess 14*a* of front plate 14 of housing 11.

In the example illustrated in the figure, second lever 81 substantially has a U shape or arch shape overall. Specifically, second lever 81 includes second body part 82 linearly extending in the transverse direction (Y axis direction), along with a pair of second legs 83 which are connected on both ends of this second body part 82 and stretch in the direction orthogonal to the direction in which second body part 82 extends. Additionally, as illustrated in FIG. 4A, bearing opening 84 serving as a circular through opening is formed in each second leg 83 and rotatably fitted around the periphery of second pivot 32 fixed on the outer face of side walls 13 of housing 11. As a result, second lever 81 is mounted in housing 11 so as to potentially swing about second pivot 32. Note that second pivot 32 is disposed in the vicinity at the front (in the X axis positive direction) end of housing 11, and in the side view, disposed about a circular arc drawn by the portion of the lower side of front plate 14.

Moreover, for the case in which the position of second lever 81 relative to housing 11 is the initial position as illustrated in FIGS. 1 and 2, as well as the position in which second legs 83 extend in the X axis direction, the side end at the back (in the X axis negative direction) of second body part 82 abuts the lower end of front plate 14 of housing 11, such that the initial position of second lever 81 is maintained. Note that when second lever 81 swings about second pivot 32, the position can be changed from the initial position to the auxiliary lock position in which second legs 83 extend in the Z axis direction.

Operation piece 82*a* is connected to the central part in the transverse direction (Y axis direction) of second body part 82, while lock state holding member 86 is connected on both ends in the transverse direction of this operation piece 82*a*. Operation piece 82*a* is a member for improving the operability upon operating second lever 81 when operated by the finger of an operator or the like, and stretches forward from the side end at the front of second body part 82 for the case in which the position of second lever 81 is the initial position. Moreover, lock state holding member 86, as illustrated in FIG. 3C, is a plate member winding in a chevron shape in the side view and includes connecting part 86*b* stretching forward from the side end at the front of second body part 82 for the case in which the position of second lever 81 is the initial position, along with body part 86*c* stretching upward from the front end (tip) of this connecting part 86*b*; and further, latch hole 86*a* serving as a through hole is formed on this body part 86*c*.

Additionally, for the case in which the position of first lever 71 is the lock position, when second lever 81 is changed from the initial position to the auxiliary lock position, body part 86*c* of lock state holding member 86 is overlapped with the upper side of body part 76*b* of lock state holding member 76 of first lever 71, and latch hole 86*a* formed in body part 86*c* engages with latch projection 76*a* of lock state holding member 76 of first lever 71. As a result, first lever 71 is auxiliary locked by second lever 81, preventing any change in position from the lock position. Note that because latch projection 76*a* is a latch member having a triangular side face shape such that the surface on the auxiliary plate part 76*c* side is an inclined face, and the end on the first body part 72 side is nearly orthogonal to body part 76*b*, the engagement with latch hole 86*a* tends not to be released, allowing the auxiliary locking between first lever 71 and second lever 81 to be assuredly maintained. The shape of latch projection 76*a* illustrated in the figure is only one example and can be appropriately changed to a square side face or the like, but is preferably a shape having an inclined face on the auxiliary plate part 76*c* side so as to be easily locked. Moreover, latch hole 86*a* is not necessarily a through hole, but may be a dent shape or the like Further, latch projection 76*a* may be formed on second lever 81, while latch hole 86*a* may be formed in first lever 71.

Note that, as required, in order to EMI shield signals passing through the inside, the vicinity of the terminal of cable 91 and the periphery of housing 11 can be covered with a shield member made of a conductive metal plate. Moreover, ground terminals obtained by connecting some of multiple terminals 61 to ground lines may also be used.

Next, the configuration of mating connector 101 will be described in detail.

Figure 5A:
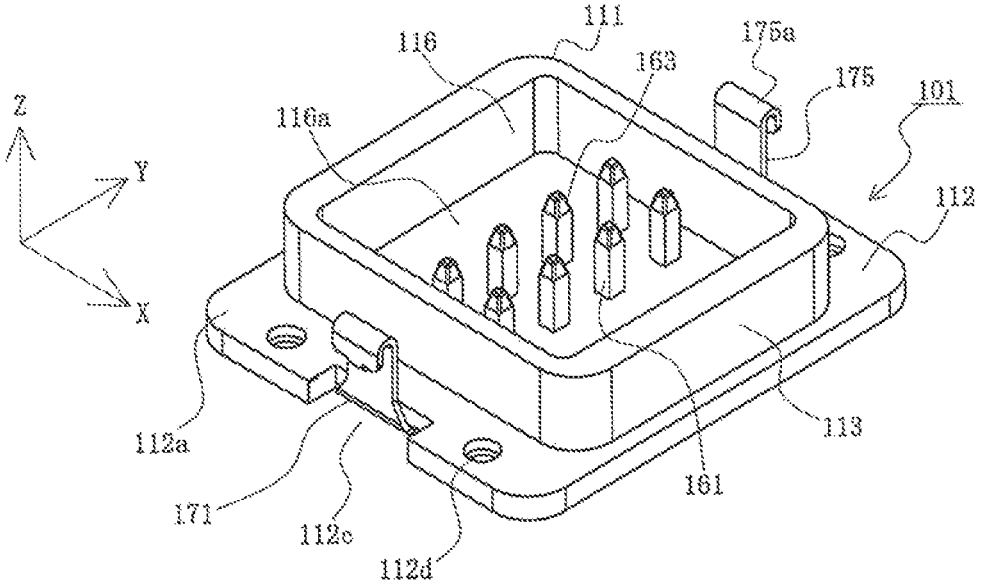
Figure 5B:
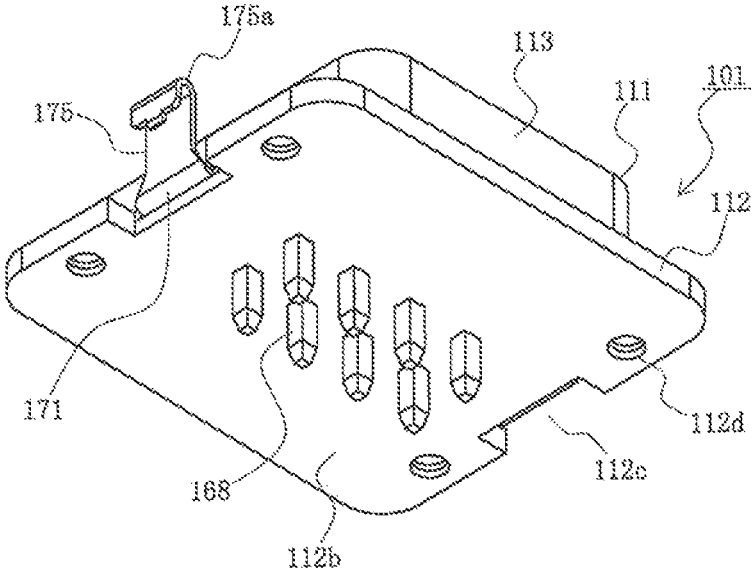
Figure 6:
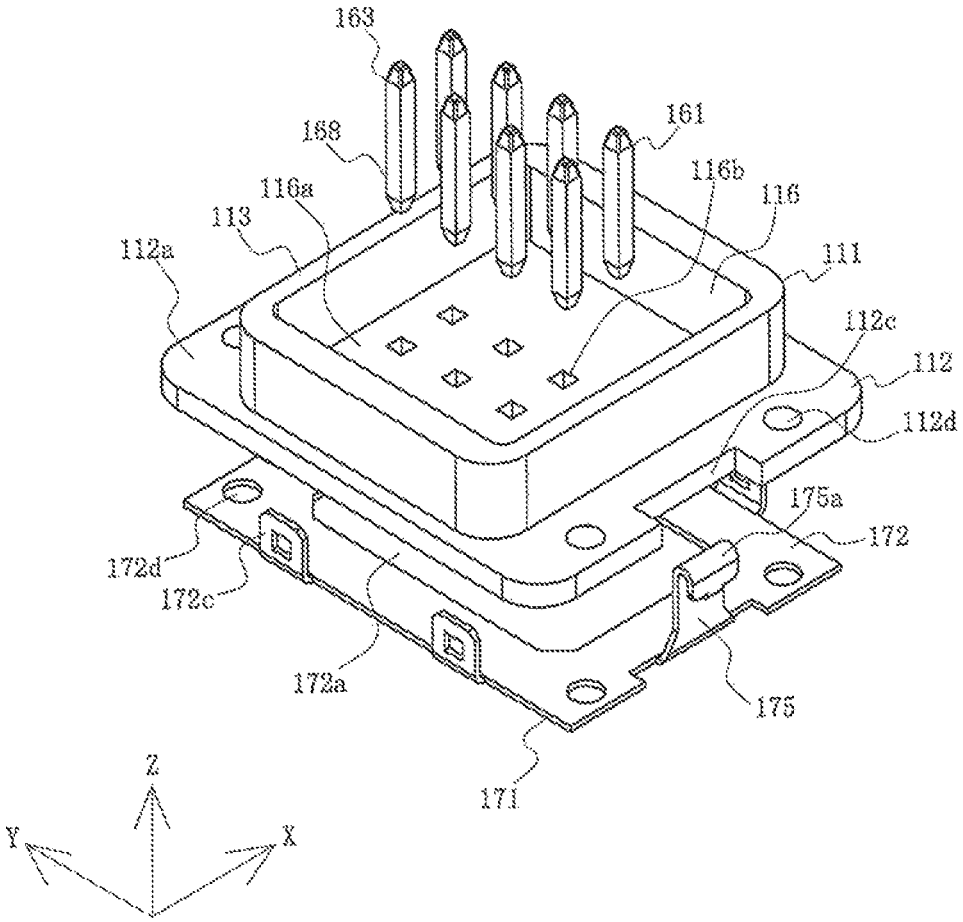
FIG. 6 is an exploded view of the mating connector according to the present embodiment.

FIGS. 5A-5B are a perspective views of a mating connector according to the present embodiment, while FIG. 6 is an exploded view of the mating connector according to the present embodiment. Note that FIG. 5A is a perspective view viewed from above, while FIG. 5B is a perspective view viewed from below.

As illustrated in the figure, mating connector 101 includes: mating housing 111 as a housing integrally formed of an insulating material such as synthetic resin; multiple (eight in the example illustrated in the figure) metal mating terminals 161 installed in this mating housing 111; and reinforcing member 171 integrally coupled to mating housing 111. Here, for convenience of description, mating connector 101 is mounted on a side wall or the like of a cabinet for storing electrical equipment, electronic equipment, or the like in transport equipment such as automobiles, as well as industrial equipment such as robots, and is electrically connected to electrical equipment, electronic equipment, or the like provided inside the cabinet.

Mating housing 111 includes substrate 112 extending in the X-Y axis direction, along with peripheral wall 113 stretching upward (in the Z axis positive direction) from upper surface 112*a* of this substrate 112. Additionally, linear bar shaped mating terminal 161 is mounted on this substrate 112 so as to pass through substrate 112 in the Z axis direction, such that the periphery thereof is surrounded by peripheral wall 113. Moreover, when viewed in the Z axis direction, peripheral wall 113 is a substantially rectangular cylindrical member and surrounds the periphery of mating terminals 161 with four mutually connected planar walls. Further, mounting holes 112*d* serving as through holes are formed in portions outside peripheral wall 113 of substrate 112, and mounting members such as bolts and pins necessary for mounting mating connector 101 on the side walls of the cabinet or the like pass through these holes.

Hollow recess 116 is formed inside peripheral wall 113. The upper end of this recess 116 is opened, while the lower end thereof is defined by recess bottom surface 116*a* serving as a portion of upper surface 112*a* of substrate 112. Note that this recess bottom surface 116*a* is desirably disposed so as to be lower than upper surface 112*a* outside peripheral wall 113, that is, in the Z axis negative direction. Additionally, as illustrated in FIG. 6, multiple (eight in the example illustrated in the figure) terminal housing holes 116*b* are formed on recess bottom surface 116*a*, with mating terminals 161 inserted and fixed in each of these terminal housing holes 116*b*. Note that while this mating terminal 161 is a member having the same cross sectional shape over the entire length, here, the portion exposed above recess bottom surface 116*a* is referred to as contact part 163, while the portion exposed below lower surface 112*b* of substrate 112 is referred to as connecting part 168 and is electrically connected to electrical equipment, electronic equipment, or the like, which are provided inside the cabinet.

Reinforcing member 171 may be made of any material, but is desirably formed by subjecting a metal plate material such as stainless steel to processing such as cutting or bending. In the example illustrated in the figure, reinforcing member 171 includes flat plate body part 172, along with mating lock member 175 stretching upward from both ends in the transverse direction (Y axis direction) of this body part 172. Body part 172 is a portion embedded in substrate 112 for the case in which reinforcing member 171, for example, is integrally coupled to mating housing 111 by a molding method referred to as insert molding or overmolding. Note that auxiliary part 172*c* stretching upward from both ends in the anteroposterior direction (X axis direction) of body part 172 is embedded in peripheral wall 113. Moreover, each peripheral through hole 172*d* formed in body part 172 corresponds to each mounting hole 112*d* formed in a portion outside peripheral wall 113 of substrate 112. Further, central through hole 172*a* formed in body part 172 is formed so as to be larger than the range of a group of terminal housing holes 116*b* formed on recess bottom surface 116*a*, such that reinforcing member 171 does not contact mating terminal 161.

With reinforcing member 171 integrally coupled to mating housing 111, mating lock member 175 stretches upward from notch part 112*c* formed on both ends in the transverse direction of substrate 112. Additionally, locking bent part 175*a* as a lock part is formed on the upper end of mating lock member 175.

Note that mating connector 101 has an axisymmetric shape in which the line passing through the center in the anteroposterior direction (X axis direction) is the symmetric axis. Additionally, the position in the anteroposterior direction (X axis direction) of reinforcing member 171 corresponds to the center in the anteroposterior direction on lower surface 112*b* of substrate 112. That is, locking bent part 175*a* is disposed in the approximate center in the anteroposterior direction of mating housing 111.

Next, the operation to mate connector 1 and mating connector 101 as configured above will be described.

Figure 7A:
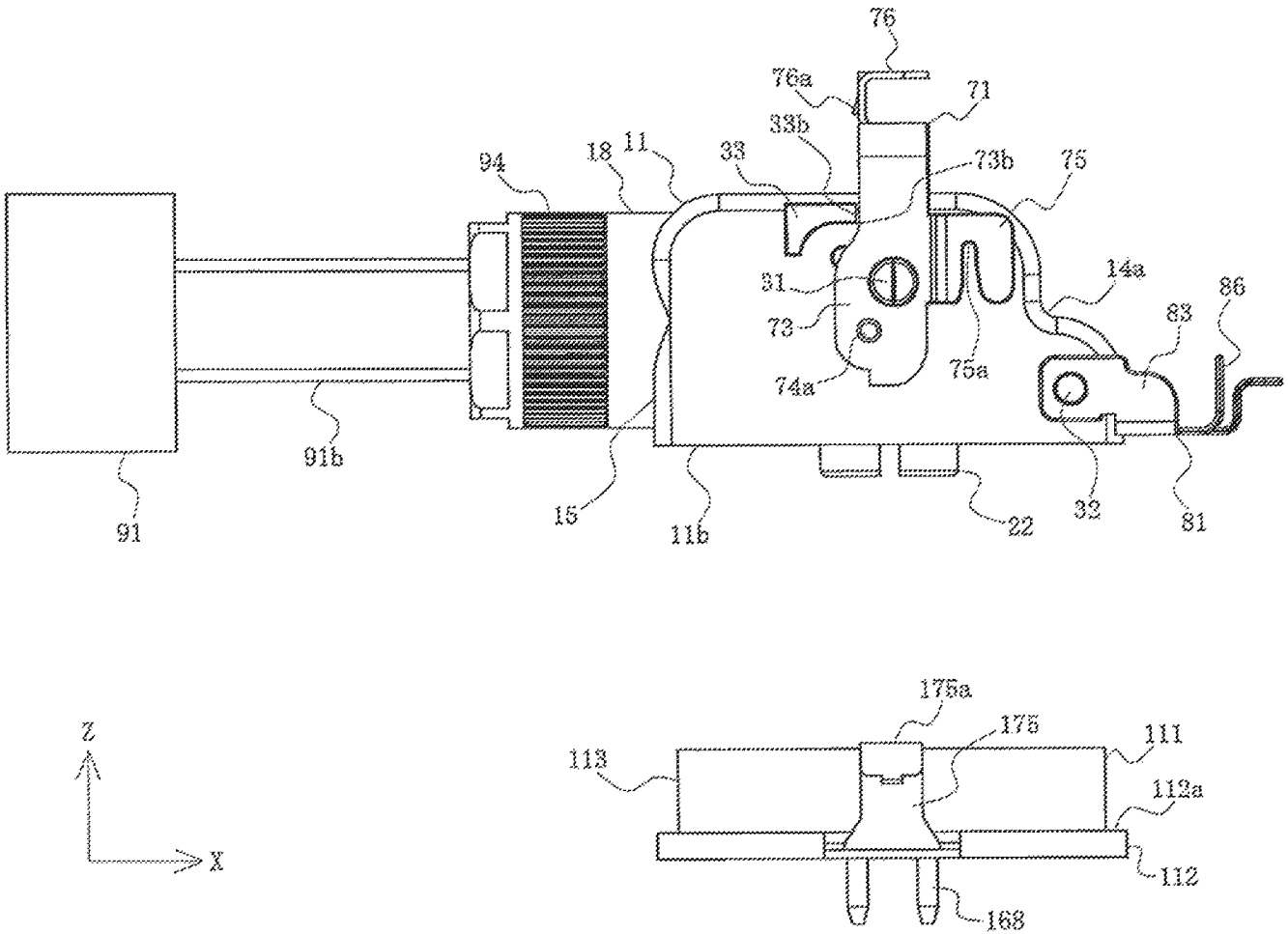
FIG. 7A is a side view illustrating a first step for mating the connector and the mating connector according to the present embodiment.
Figure 7B:
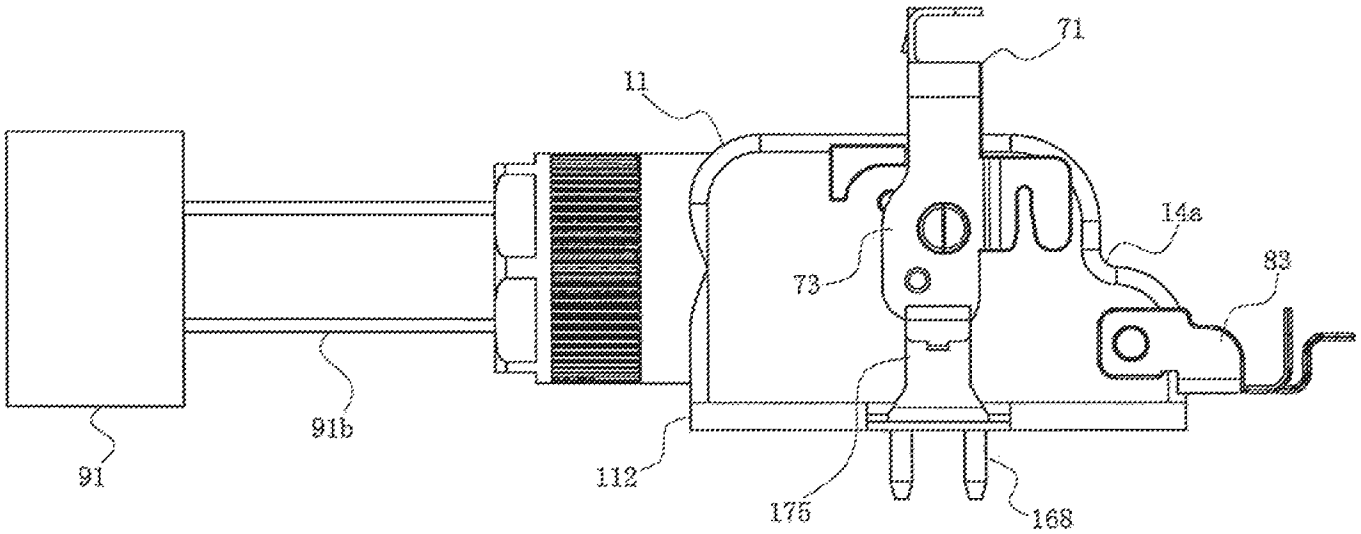
FIG. 7B is a side view illustrating a second step for mating the connector and the mating connector according to the present embodiment.
Figure 8A:
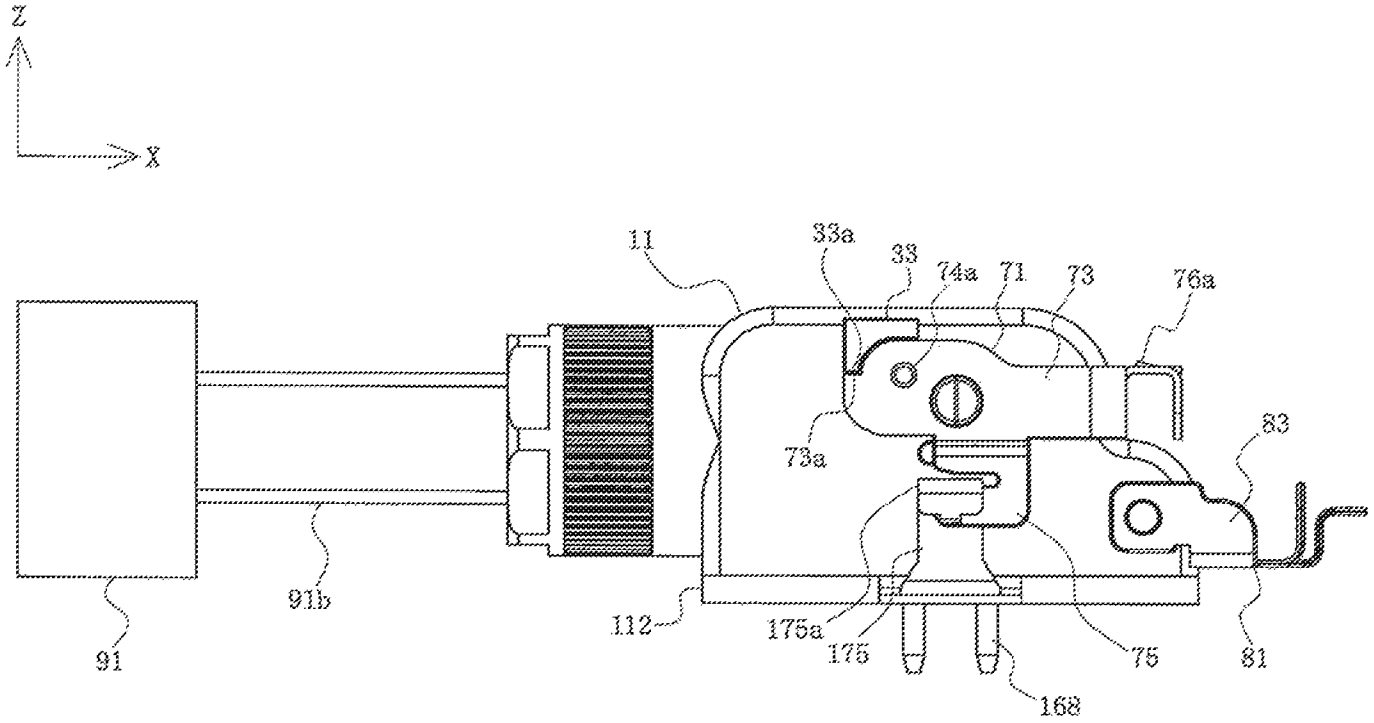
FIG. 8A is a side view illustrating a third step for mating the connector and the mating connector according to the present embodiment.
Figure 8B:
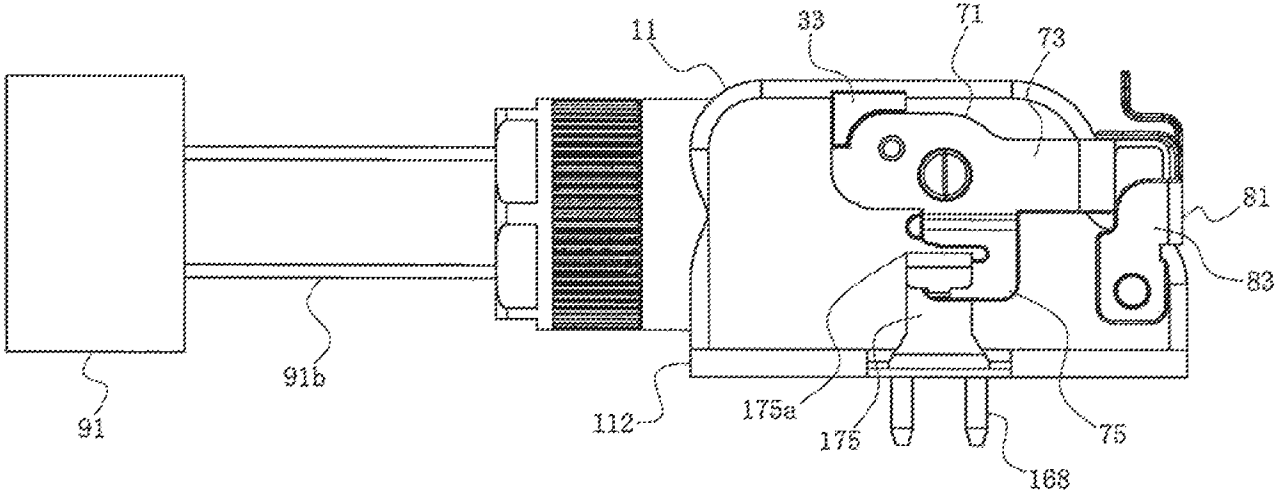
FIG. 8B is a side view illustrating a fourth step for mating the connector and the mating connector according to the present embodiment.
Figure 9:
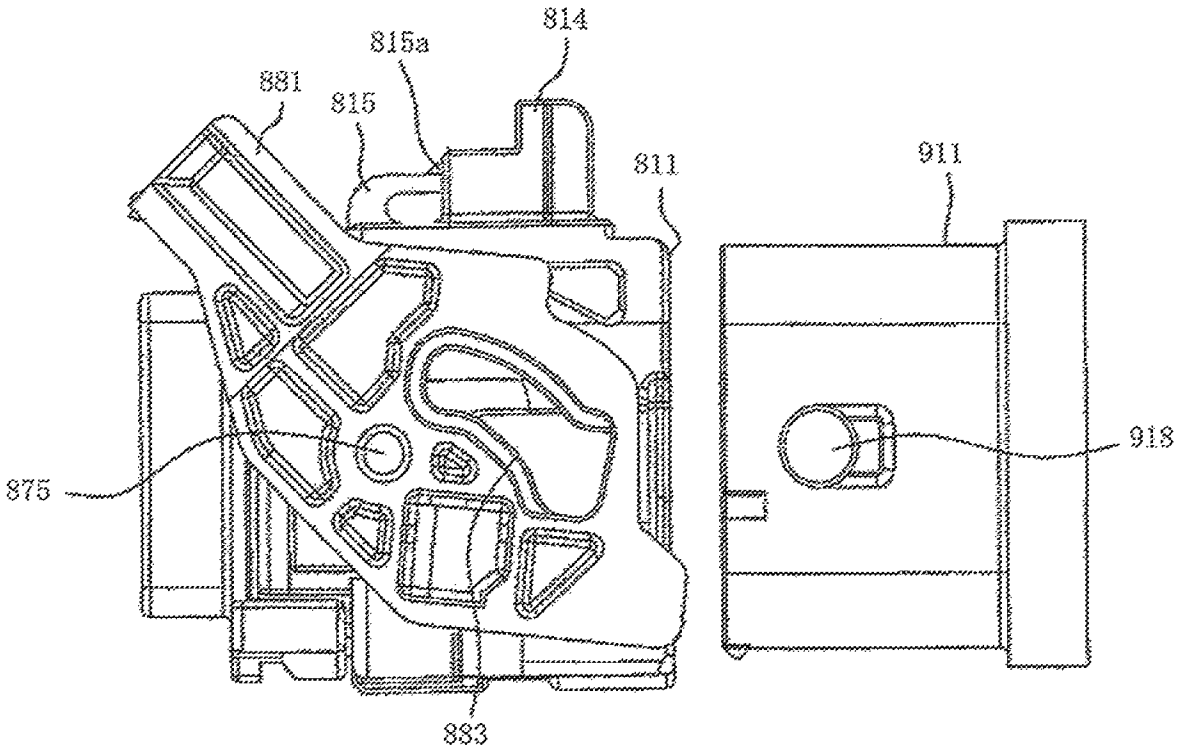
FIG. 9 Prior Art
FIG. 9 is a side view illustrating a conventional connector and mating connector.

FIGS. 7A-7B are side views illustrating the first step and the second step for mating the connector and the mating connector according to the present embodiment, while FIGS. 8A-8B are side views illustrating the third step and the fourth step for mating the connector and the mating connector according to the present embodiment. Note that FIG. 7A is a view illustrating the first step and FIG. 7B is a view illustrating the second step, while FIG. 8A is a view illustrating the third step and FIG. 8B is a view illustrating the fourth step.

In order to mate connector 1 and mating connector 101, an operator holds connector 1 by finger or the like, and as illustrated in FIG. 7A, sets the position such that lower surface 11*b* of housing 11 serving as the mating face of connector 1 is opposite upper surface 112*a* of substrate 112 serving as the mating face of mating connector 101. Note that mating connector 101 is mounted and fixed to the side walls or the like of the cabinet for storing electrical equipment, electronic equipment, or the like, in advance. Moreover, the position of first lever 71 and second lever 81 is set to the initial position in advance.

Subsequently, the operator makes connector 1 relatively approach mating connector 101, makes peripheral wall 113 of mating housing 111 enter recess 16 of housing 11, and also makes contact part 163 of each mating terminal 161 enter mating terminal receiving opening 23*a* which opens to lower surface 22*a* of corresponding terminal holding part 22. Additionally, lower surface 11*b* of housing 11 is made to approach or abut upper surface 112*a* of substrate 112. As a result, as illustrated in FIG. 7B, connector 1 and mating connector 101 are mated together, and contact part 163 of each mating terminal 161 contacts contact part 63 of each terminal 61 housed in terminal housing recess 23 of corresponding terminal holding part 22, so as to be conducted together.

Note that the dimension in the X axis direction and Y axis direction outside peripheral wall 113 is set to be slightly smaller than the dimension in the X axis direction and Y axis direction inside recess 16. As a result, with peripheral wall 113 entering recess 16, the outer face of peripheral wall 113 and the inner face of recess 16 face together so as to approach or abut each other, allowing peripheral wall 113 to mate with recess 16 without any play. Accordingly, connector 1 and mating connector 101 mated together are precisely aligned and not displaced together even if an external force is received in the mating direction or the X axis direction and Y axis direction orthogonal to the mating release direction (Z axis direction).

Subsequently, the operator operates operation piece 72*a* by finger or the like, and changes the position of first lever 71 from the initial position to the lock position. Thereupon, lock member 75 swings about first pivot 31 and is displaced in the Z axis negative direction and the X axis negative direction; wherein, as illustrated in FIG. 8A, lock recess 75*a* formed in lock member 75 engages with locking bent part 175*a* formed in mating lock member 175, immediately below first pivot 31. As a result, connector 1 and mating connector 101 are locked in the mating state, preventing the mating therebetween from being released.

Subsequently, the operator operates operation piece 82*a* by finger, or the like, and changes the position of second lever 81 from the initial position to the auxiliary lock position. Thereupon, lock state holding member 86 swings about second pivot 32 and is displaced in the Z axis positive direction and X axis negative direction; wherein, as illustrated in FIG. 8B, body part 86*c* of lock state holding member 86 overlaps with the upper side of body part 76*b* of lock state holding member 76 of first lever 71, while latch hole 86*a* formed in body part 86*c* engages with latch projection 76*a* of lock state holding member 76 of first lever 71. As a result, because first lever 71 is auxiliary locked by second lever 81, first lever 71 is prevented from changing position from the lock position even if an external force is received such as an impact or vibrations, such that the mating between connector 1 and mating connector 101 is assuredly prevented from being released.

Note that, as mentioned above, mating connector 101 has an axisymmetric shape in which the line passing through the center in the anteroposterior direction is the symmetric axis, and locking bent part 175*a* is disposed in the approximate center in the anteroposterior direction of mating housing 111. Moreover, first pivot 31 serving as the center of swinging of lock member 75 in connector 1 is disposed in the approximate center in the anteroposterior direction of housing 11, while lock recess 75*a* engages with locking bent part 175*a* immediately below first pivot 31. Accordingly, even if the orientation in the anteroposterior direction of connector 1 is opposite the orientation illustrated in FIGS. 7A-7B and FIGS. 8A-8B, connector 1 can mate with mating connector 101.

In this way, in the present embodiment, connector 1 includes: housing 11 for housing terminals; first lever 71 which is mounted in housing 11 to allow change of position between an initial position and a lock position, and which allows locking of mating lock member 175 of mating connector 101 in the lock position; and second lever 81 which is mounted in housing 11 to allow change of position between an initial position and an auxiliary lock position, and which allows locking of first lever 71 at the lock position in the auxiliary lock position.

As a result, the locking of mating lock member 175 is not released by first lever 71 even if an external force is received such as an impact or vibrations, allowing the mating state with mating connector 101 to be assuredly maintained. Additionally, the structure of connector 1 can be simplified, enabling cost reduction, as well as improved reliability.

Moreover, first lever 71 and second lever 81 are locked by latch projection 76*a* serving as a latch member. Further, latch projection 76*a* is present at two locations in the width direction. Accordingly, the locking of first lever 71 is assuredly maintained by second lever 81.

Further, second lever 81 includes operation piece 82*a*, with operation piece 82*a* present between latch projections 76*a* at two locations in the width direction. Accordingly, the operator can easily operate second lever 81 and lock first lever 71.

Further, first lever 71 and second lever 81 are swingably mounted in housing 11, such that the direction in which first lever 71 swings from the initial position to the lock position is opposite the direction in which second lever 81 swings from the initial position to the auxiliary lock position. Accordingly, the operator can easily and assuredly carry out the operation of first lever 71 and second lever 81. Moreover, locking of first lever 71 by second lever 81 can be confirmed visually.

Further, mating connector 101 includes mating terminals 161 contactable with terminals 61, along with mating housing 111 including peripheral wall 113 surrounding the periphery of mating terminals 161, housing 11 includes recess 16 that mates with peripheral wall 113, and the mating between peripheral wall 113 and recess 16 prevents displacement in the direction (X-Y axis direction) orthogonal to the mating release direction (Z axis direction) of housing 11 from mating housing 111. Moreover, displacement in the mating release direction of housing 11 from mating housing 111 is prevented by first lever 71 locking mating lock member 175. Accordingly, connector 1 and mating connector 101 mated together are not displaced together even upon receiving external force.

Note that the disclosure of the present specification describes characteristics related to preferred and exemplary embodiments. Various other embodiments, modifications and variations within the scope and spirit of the claims appended hereto could naturally be conceived by persons skilled in the art by summarizing the disclosures of the present specification.

The present disclosure can be applied to connectors.

The invention claimed is:

1. An electrical connector configured to be mated with a mating electrical connector, the electrical connector comprising:

a housing;

at least one terminal housed in the housing;

a first lever mounted to the housing, the first lever being movable between a first unlocked position and a first locked position, wherein, when the first lever is in the first locked position, the first lever is configured to lock the mating electrical connector in place relative to the electrical connector; and a second lever mounted to the housing, the second lever being movable between a second unlocked position and a second locked position, wherein, when the second lever is in the second locked position, the second lever is configured to lock the first lever in the first locked position, wherein, when the first lever is in the first locked position, the second lever is configured to be in either the second unlocked position or the second locked position.

2. The electrical connector according to claim 1, wherein the first and second levers are each pivotally mounted to the housing.

3. The electrical connector according to claim 1, wherein the first lever moves from the first unlocked position to the first locked position in a first direction, and wherein the second lever moves from the second unlocked position to the second locked position in a second direction, wherein the first direction is opposite the second direction.

4. The electrical connector according to claim 3, wherein the first and second levers are each pivotally mounted to the housing.

5. A connector assembly comprising:

a first connector having a first housing, at least one first terminal, a first lever and a second lever, the first housing having a recess, the at least one first terminal being housed in the first housing, the first lever being mounted to the first housing, the first lever being movable between a first unlocked position and a first locked position, the second lever being mounted to the first housing, the second lever being movable between a second unlocked position and a second locked position; and a second connector having a second housing, at least one second terminal, and a lock member, the at least one second terminal being housed in the second housing, the second connector configured to be mated to the first connector, whereby when the second connector is mated to the first connector, the at least one second terminal is in electrical contact with the at least one first terminal, wherein, when the first lever is in the first locked position, the first lever is configured to engage the lock member, thereby locking the first connector in place relative to the second connector, wherein, when the second lever is in the second locked position, the second lever is configured to lock the first lever in the first locked position, and wherein, when the first lever is in the first locked position, the second lever is configured to be in either the second unlocked position or the second locked position.

6. The connector assembly according to claim 5, wherein the second housing has a peripheral wall surrounding a periphery of the at least one second terminal, the peripheral wall configured to be received within the recess of the first housing.

7. The connector assembly according to claim 5, wherein the first and second levers are each pivotally mounted to the first housing.

8. The connector assembly according to claim 5, wherein the first lever moves from the first unlocked position to the first locked position in a first direction, and wherein the second lever moves from the second unlocked position to the second locked position in a second direction, wherein the first direction is opposite the second direction.

9. The connector assembly according to claim 8, wherein the first and second levers are each pivotally mounted to the first housing.

10. A method of mating a first connector to a second connector, the method comprising the steps of:

a) providing a first connector having a first housing, at least one first terminal, a first lever and a second lever, the first housing having a recess, the at least one first terminal being housed in the first housing, the first lever being mounted to the first housing, the first lever being movable between a first unlocked position and a first locked position, the second lever being mounted to the first housing, the second lever being movable between a second unlocked position and a second locked position;

b) providing a second connector having a second housing defining a peripheral wall, at least one second terminal, and a lock member, the at least one second terminal being housed in the second housing, the peripheral wall surrounding a periphery of the at least one second terminal;

c) causing the peripheral wall of the second connector to enter the recess of the first connector, thereby causing the at least one terminal of the second connector to come into electrical contact with the at least one terminal of the first connector;

d) moving the first lever from the first unlocked position to the first locked position, whereby the first lever engages the lock member of the second connector, thereby locking the first connector in place relative to the second connector; and e) upon completion of step (d), moving the second lever from the second unlocked position to the second locked position, whereby the second lever engages the first lever, thereby locking the first lever in place relative to the second lever.

11. The method according to claim 10, wherein the first and second levers are each pivotally mounted to the first housing.

12. The method according to claim 10, wherein the first lever moves from the first unlocked position to the first locked position in a first direction, and wherein the second lever moves from the second unlocked position to the second locked position in a second direction, wherein the first direction is opposite the second direction.

13. The method according to claim 12, wherein the first and second levers are each pivotally mounted to the first housing.

* * * * *